United States Patent [19]

Shigemitsu et al.

[11] Patent Number: 4,536,751

[45] Date of Patent: Aug. 20, 1985

[54] SYSTEM FOR DETECTING AN ALARM

[75] Inventors: Mineo Shigemitsu, Tokyo; Ichiyo Maruyama, Chofu; Shigeru Niimura, Mitaka, all of Japan

[73] Assignee: Secom Co., Ltd., Tokyo, Japan

[21] Appl. No.: 507,096

[22] Filed: Jun. 23, 1983

[30] Foreign Application Priority Data

Jun. 30, 1982 [JP] Japan ..... 57-111441

[51] Int. Cl.[3] ..... G08B 21/00

[52] U.S. Cl. ..... 340/545; 340/511

[58] Field of Search ..... 340/545, 546, 562, 660, 340/664, 506, 507, 511, 540, 547, 662, 661, 663

[56] References Cited

U.S. PATENT DOCUMENTS 4,170,005 10/1979 Duke ..... 340/547

4,361,833 11/1982 Allgood ..... 340/506 X 4,441,100 4/1984 Galloway ..... 340/506 X

*Primary Examiner*—James L. Rowland

*Assistant Examiner*—Chi K. Lau

*Attorney, Agent, or Firm*—Armstrong, Nikaido, Marmelstein & Kubovcik

[57] ABSTRACT

A system for detecting an alarm for emergency situations of a door or a window of a building or house in a predetermined guard area, comprising: an alarm circuit, including a plurality of alarm switch units for detecting emergencies and a resistor and a capacitor connected between first contacts and second contacts of the alarm switch units; and an alarm device, including a detecting circuit for detecting voltage changes of a predetermined measuring point, a pulse oscillator for generating a pulsating voltage, and a transistor for repeatedly turning on and off the current in response to the pulsating voltage applied from the pulse oscillator.

3 Claims, 5 Drawing Figures

SYSTEM FOR DETECTING AN ALARM

BACKGROUND OF THE INVENTION

1. Field of the Invention

The present invention relates to a system for detecting an alarm (hereinafter, an alarm system) for detecting emergencies in a predetermined guard area of a building or house, such as unauthorized intrusions, cutting of wires or short-circuit by intruders, and nonsecured doors or windows, using alarm switch units installed to the doors or windows.

2. Description of the Prior Art

A conventional alarm system disclosed in Japanese Examined Patent Publication (Kokoku) No. 57-16395, as shown in FIGS. 1 and 2, comprises permanent magnets 2 installed to the upper portion of doors 1; alarm switch units $S_{11}$ to $S_{1n}$ having lead switches installed to the upper portion of door frames 3 corresponding to the magnets 2, for detecting unauthorized intrusions, nonsecured doors, cutting of wires, or short-circuits by intruders in response to removal of the magnetic flux of the magnets 2; and an alarm device AL including a power source E, buzzer BZ, and lamp L, and a detecting circuit DET.

The alarm switch units $S_{11}$ to $S_{1n}$ are connected in a circuit. Each consists of a first contact 12 which opens at emergencies, a second contact 13, and a main contact 11. A resistor R is connected between the first contact 12 and the second contact 13 of the alarm switch $S_{1n}$. A constant current flows in the circuit under ordinary conditions. When the wire (W) is cut at any point in the circuit, or a door is opened by an intruder, the circuit changes an current value. This change is detected by the detecting circuit DET, whereby the buzzer BZ or lamp L indicates the emergency.

However, in this alarm circuit, a constant current must always flow in the circuit, which entails high power consumption.

SUMMARY OF THE INVENTION

The primary object of the present invention is to provide a wired alarm system which can detect emergencies, such as unauthorized intrusions, cutting of wires or short-circuits by intruders, or nonsecured doors or windows, in a predetermined guard area of a building or house.

Another object of the present invention is to provide a wired alarm system ensuring highly reliable monitoring in the predetermined guard area of the building or house and operating on low battery consumption.

In accordance with the present invention, there is provided an alarm system comprising an alarm circuit including a plurality of alarm switch units having one contact or two contacts for detecting emergencies of doors or windows in a predetermined guard area of a building or house and including a resistor and a capacitor connected between first contacts and second contacts of the alarm switch units; and a alarm device including a detecting circuit for detecting voltage changes of a predetermined measuring point, a pulse oscillator for generating pulsating voltage, and a transistor for repeatedly turning on and off the current in response to the pulsating voltage supplied from the pulse oscillator.

DESCRIPTION OF THE PREFERRED EMBODIMENTS

Figure 1:
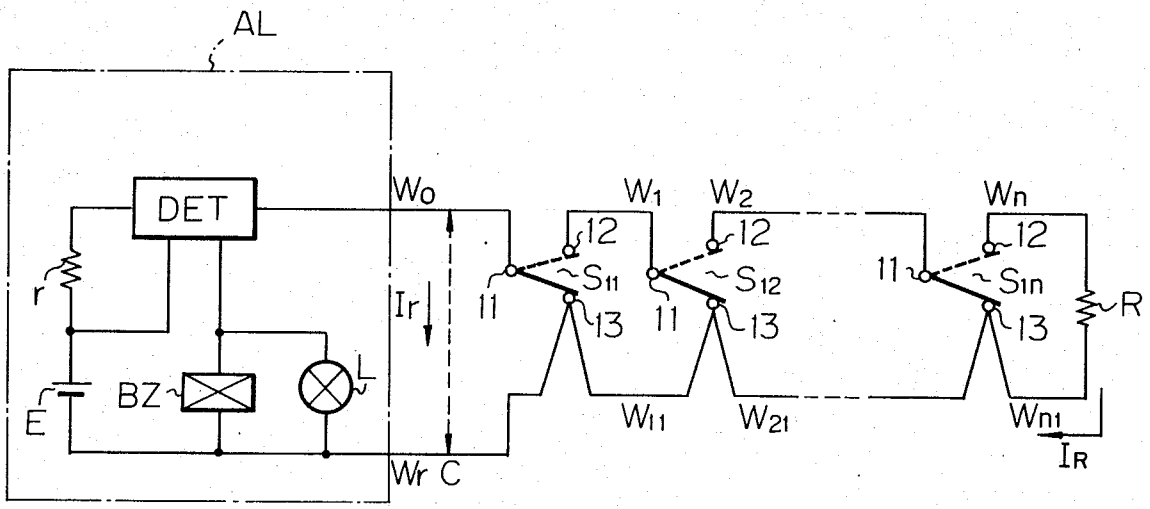
Fig. 1 PRIOR ART
FIG. 1 is an alarm system of the prior art.
Figure 2:
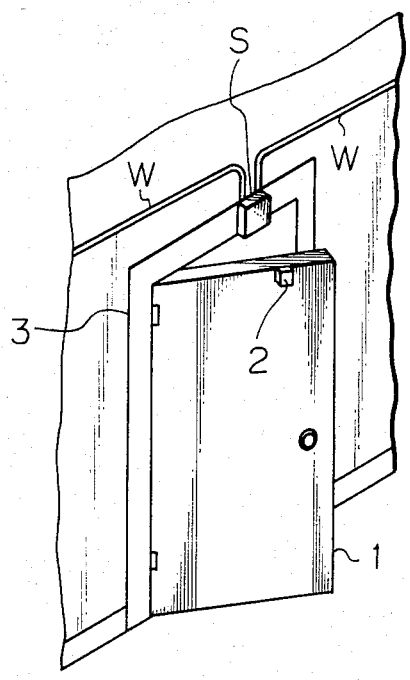
Fig. 2 PRIOR ART
FIG. 2 is a perspective view of an alarm switch installed to the door of the building according to the prior art and the present invention.
Figure 3:
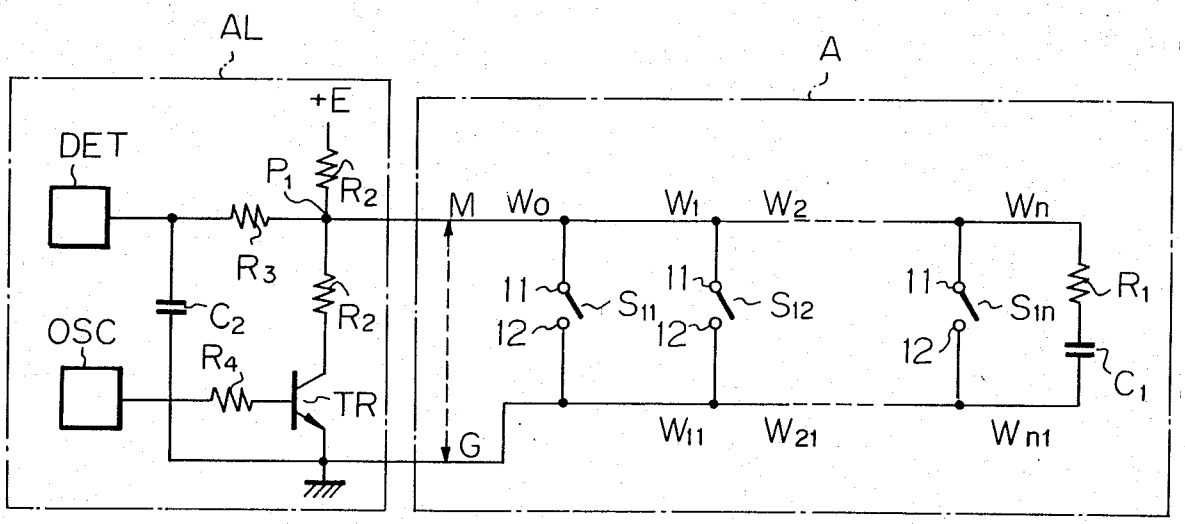
FIG. 3 is an alarm system in one embodiment of the present invention.

Referring to FIGS. 2 and 3, an alarm system of the present invention comprises an alarm circuit A and an alarm device AL. The alarm circuit A includes a plurality of alarm switch units ($S_{11}$ to $S_{1n}$), having one contact which closes in emergencies, for detecting emergencies such as deliberate short-circuiting of alarm switch units ($S_{11}$ to $S_{1n}$) and nonsecured doors 2 by intruder and a resistor $R_1$ and a capacitor $C_1$ connected in series between the first contacts 11 and the second contacts 12 of the alarm switch units. The alarm device AL comprises a detecting circuit DET for detecting a voltage change of a measuring point $P_1$ and transmitting an alarm signal to a buzzer and a lamp (not shown), a pulse oscillator OSC for generating pulsating voltage with a constant period and a transistor TR for repeatedly turning on and off the current in response to the pulsating voltage applied from the pulse oscillator OSC.

In the above-mentioned structure, when the capacitor $C_1$ is charged by a power source under ordinary conditions, no current flows in the circuit A. Accordingly, the voltage of point $P_1$ is equal to the power source voltage E. Also, when the pulsating voltage of the pulse oscillator OSC is applied to the base of the transistor TR via a resistor $R_4$, the transistor TR turns on, but the voltage of point $P_1$ is approximately equal to the power source voltage E because of the discharge of the capacitor $C_1$.

Consequently, if no emergency occurs in the predetermined guard area, the voltage of point $P_1$ is equal to the power source voltage E. This voltage is detected by the detecting circuit DET of the alarm device AL. The detecting circuit DET judges this as an "ordinary condition" and, in this case, does not transmit any signal to the buzzer and the lamp.

When an emergency such as the opening of a door by an intruder occurs in the predetermined guard area of a building or house, an alarm switch unit ($S_{11}$ to $S_{1n}$) closes the contact and current flows to the ground therethrough, whereby the voltage of point $P_1$ is equal to zero volt. Also, in case of short-circuit between point M and G by intruder, the voltage of point $P_1$ is the same value. Even though pulsating voltage is applied to the base of the transistor TR, the voltage of point $P_1$ is equal to zero volt since point $P_1$ is connected to the ground. This voltage of point $P_1$ is detected by the detecting circuit DET. The detecting circuit DET judges this as a "nonsecured door", namely "intrusion" or "short-circuit by intruder" and transmits an emergency signal to the buzzer and the lamp.

When an emergency such as cutting of an alarm wire by an intruder occurs at any point of the wire, current no longer flows in the circuit A. However, when the transistor TR turns on in response to the pulsating voltage of the pulse oscillator OSC, the voltage of point $P_1$ is equal to a half of the power source voltage E since two resistors $R_2$ divide the voltage E into E/2. This voltage of point $P_1$ is detected by the detecting circuit DET. The detecting circuit DET judges this as a "cut wire" and transmits an emergency signal to the buzzer and the lamp.

As mentioned above, when the transistor turns on in response to pulsating voltage applied from the pulse oscillator OSC, the point $P_1$ indicates one of three different voltages, namely, E, O, and E/2, in accordance with the "ordinary condition", "unauthorized intrusion or short-circuit", and "cut wire". The detecting circuit DET of the alarm device AL detects these voltages and, if point $P_1$ is "0" or "E/2", transmits an emergency signal to the buzzer and the lamp.

If the alarm switches units are provided with a contact which opens at emergencies, the voltage of point $P_1$ is 0, E, and E/2 at an "ordinary condition", "unauthorized intrusion" and "cut wire" respectively.

Figure 4:
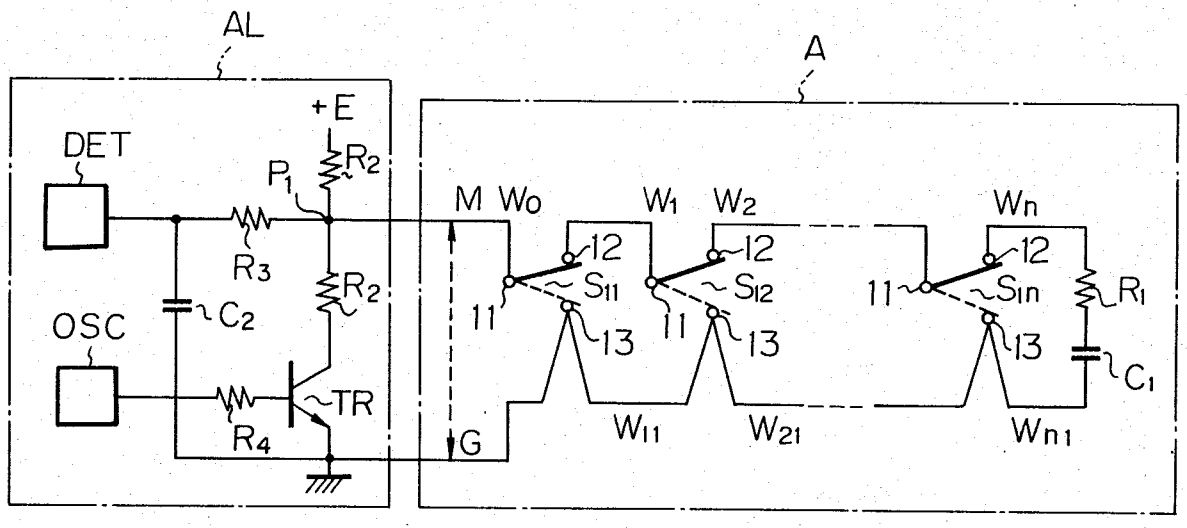
FIG. 4 is an alarm system in another embodiment of the present invention.

FIG. 4 shows an alarm system of another embodiment of the present invention. Here, the alarm circuit A includes a plurality of alarm switch units ($S_{11}$ to $S_{1n}$), of the two contact type, having first contacts 12 and second contacts 13, for detecting emergencies and a resistor $R_1$ and a capacitor $C_1$ connected in series between a first contact 12 and a second contact 13 of the alarm switch unit $S_{1n}$. The alarm device AL is similar in structure with the alarm device AL shown in FIG. 3. The first contact 12 of the alarm switch unit $S_{1n}$ opens at emergencies, and the second contact 13 closes at emergencies.

The operation of the alarm system of FIG. 4 is similar with that of the alarm system shown in FIG. 3. The voltage of point $P_1$ is equal to E, 0, and E/2 under an "ordinary condition", "unauthorized intrusion", and "cut wire", respectively. The detecting circuit DET detects these voltages.

If the first contact 12 of the alarm switch unit $S_{1n}$ closes at emergencies and the second contact 13 opens at emergencies, the voltage of point $P_1$ is O, E, and E/2 under an "ordinary condition", "unauthorized intrusion", and "cut wire", respectively. The detecting circuit DET of the alarm device AL detects these voltages and, if point $P_1$ is "E" or "E/2", transmits an emergency signal to the buzzer and the lamp.

Figure 5:
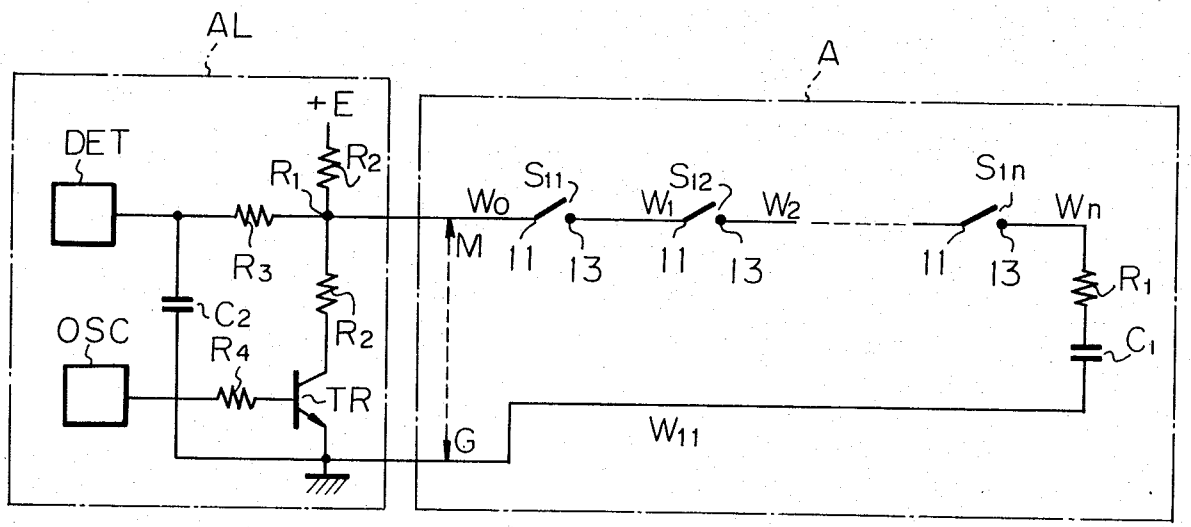
FIG. 5 is an alarm system in still another embodiment of the present invention.

FIG. 5 shows an alarm system of still another embodiment of the present invention. The alarm circuit A comprises a plurality of series-connected alarm switch units ($S_{11}$ to $S_{1n}$), for detecting emergencies and a resistor $R_1$ and a capacitor $C_1$ connected in series to the alarm circuit A. The alarm device AL is similar in structure with the alarm device AL shown in FIG. 3. The alarm switch units ($S_1$ to $S_{1n}$) have contacts which open at emergencies.

The operation of the alarm system of FIG. 5 is similar with that of the alarm system shown in FIG. 3. The voltage of point $P_1$ is equal to E, E/2, and 0 in under an "ordinary condition", "unauthorized intrusion" or "cut wire", and "short-circuiting of the circuit". The detecting circuit DET detects these voltages.

As mentioned above, since an alarm system of the present invention does not require current in the circuit under ordinary conditions, the battery consumption can be reduced greatly in comparison with the prior alarm system.

Although preferred embodiments of the present invention have been described heretofore, it should be understood that various modifications and alterations of the embodiments are possible.

For example, a microprocessor can be used instead of the pulse oscillator and the transistor in order to control the current in the circuit.

We claim:

1. A system for detecting an alarm for emergency situations in a predetermined guard area of a building or house, comprising:

an alarm circuit including at least one or more alarm switch units for detecting the emergencies and a resistor and a capacitor connected between first contacts and second contacts of said alarm switch units; and an alarm device including a detecting circuit for detecting voltage changes of a predetermined measuring point, a pulse oscillator for generating a pulsating voltage, and a transistor for repeatedly turning on and off the current in response to the pulsating voltage applied from said pulse oscillator;

wherein no current flows in said alarm circuit after said capacitor is charged up, and a small amount of discharge current flows when said pulsating voltage is applied to the base of said transistor, then, such states are repeated under an ordinary condition of said predetermined guard area, current flows in said alarm circuit under emergencies, and the voltage change is detected at said measuring point of said alarm device.

2. A system for detecting an alarm as claimed in claim 1, characterized in that each of said alarm switch units comprises one contact which closes or opens at emergencies.

3. A system for detecting an alarm as claimed in claim 1, characterized in that each of said alarm switch units comprises two contacts which close or open at emergencies.

* * * * *